US006017187A

United States Patent [19]

Mueller

[11] Patent Number: 6,017,187

[45] **Date of Patent: *Jan. 25, 2000**

[54] DEVICE FOR REDUCING NOISE IN CENTRIFUGAL PUMPS

[75] Inventor: Bernd Mueller, Worms, Germany

[73] Assignee: KSB Aktiengesellschaft, Frankenthal, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/716,378

[22] PCT Filed: Mar. 15, 1995

[86] PCT No.: PCT/EP95/00963

§ 371 Date: Sep. 19, 1996

§ 102(e) Date: Sep. 19, 1996

[87] PCT Pub. No.: WO95/25895

PCT Pub. Date: Sep. 28, 1995

[30] Foreign Application Priority Data

Mar. 19, 1994 [DE] Germany ..... 44 09 475

[51] Int. Cl.[7] ..... F04D 29/44

[52] U.S. Cl. ..... 415/208.1; 415/208.2; 415/208.3

[58] Field of Search ..... 415/208.1, 208.2, 415/208.3, 211.1, 211.2

[56] References Cited

U.S. PATENT DOCUMENTS 5,595,473 1/1997 Nagaoka et al. ..... 415/199.1

FOREIGN PATENT DOCUMENTS

| | | |
|---|---|---|
| 352 787 | 3/1905 | France . |
| 361 986 | 12/1905 | France . |
| 1 091 307 | 1/1954 | France . |
| 319721 | 3/1920 | Germany . |
| 2 422 364 | 12/1974 | Germany . |
| 1 579 24 | 12/1982 | Germany . |
| 43 13 617 | 5/1994 | Germany . |
| 43 09 479 | 9/1994 | Germany . |
| 51-91006 | 8/1976 | Japan . |
| 59-231199 | 12/1984 | Japan . |
| 626 954 | 12/1981 | Switzerland . |
| 91/13259 | 9/1991 | WIPO . |

OTHER PUBLICATIONS

Florjancic, D. et al., "Primary Noise Abatement on Centrifugal Pumps", Sulzer Technical Review, 1980, 24–26.

"Development of noise and vibration performance of building services pumps", World Pumps, Jun. 1993, pp. 23–28.

*Primary Examiner*—John Kwon

*Attorney, Agent, or Firm*—Evenson, McKeown, Edwards & Lenahan, P.L.L.C.

[57] ABSTRACT

The object of the invention is a device for reducing the hydraulic operating noise in centrifugal pumps. To this end, the flow edges of a guide device downstream of an impeller are in oblique array. Here, the flow edges may be linear or nonlinear.

19 Claims, 5 Drawing Sheets

DEVICE FOR REDUCING NOISE IN CENTRIFUGAL PUMPS

BACKGROUND OF THE INVENTION

The invention relates to a guide device in a centrifugal pump having at least one impeller and a diffuser device arranged following the impeller.

In the article "Development of noise and vibration performance of building services pumps" from the periodical WORLD PUMPS, June 1993, Pages 23–28, the most varied sound and noise sources in the operation of a centrifugal pump are described. One of the possible causes are flow-dynamic sound developments because of flow turbulence, flow interruptions as well as cavitation phenomena. These also include the sound development caused by the interaction between the impeller and the diffuser arranged behind it. When the blade ends of an impeller move past the leading edge or edges of a following diffuser, pressure pulsations occur in the flow medium. These are superimposed on the static pressure inside the pump housing. The magnitude of these pressure pulsations as well as their behavior are essentially determined by the distance between the impeller outlet and the inlet into the diffuser. Small distances cause large pressure pulsations which can be decreased by enlarging the distance, but at the cost of a loss of efficiency and negative repercussions on the course of the characteristic curve. Furthermore, it is recommended to change the number of such hindrances behind an impeller. A profile change of the back face of the impeller blades is also suggested.

Other measures are known from WO 91/13259 and DE-OS 24 22 364, by means of which pulsations of the flow stream of centrifugal pumps having a spiral casing are to be avoided. For this purpose, WO 91/13259 envisions an oblique positioning of the trailing edges of the impeller blades and the use of additional intermediate blades. This oblique orientation of the impeller blade ends, which necessarily occurs in the case of spatially curved impeller blades, exhibits a known more favorable pulsation behavior. For this purpose, an oblique positioning was selected, at which the transitions between the trailing edges of the blades and one impeller cover disk are arranged offset by the distance to an adjacent blade on the opposite impeller cover disk. To a certain extent, the transition points between the blade trailing edge and the cover disk are situated in parallel to the axis of rotation, while the course of the blade trailing edge extends by the offset of a blade spacing diagonally between the transition points. In this case, the opposing hydraulic limits and manufacturing limits are disadvantageous since, for hydraulic reasons, the curvature, the outlet angle of the impeller blades as well as their oblique positioning, can only be varied within a relatively small angular range relative to the axis of rotation because otherwise a desired operating point of the pump cannot be achieved. Such changes may lead to losses in efficiency.

In contrast, in DE-OS 24 22 364, an impeller is used in which the number of blade channels and the blade number is increased by the use of an intermediate wall. As the result of the offset arrangement of the blades by half a blade pitch, a pulsation frequency is obtained which is twice as high in comparison to a diffuser apparatus which interacts with a normal impeller. The principle on which this is based envisions a reduction of the rate of flow per blade channel, whereby the pulsation energy is decreased.

Through the U.S. Pat. No. 2,018,097, a simply operating centrifugal pump is known. A radial wheel rotates in a pot-form housing and pumps into an annular space. In the annular space, radial vanes mounted on the inner wall surface of the housing, which vanes extend in screw-form to the pressure side wheel side space. The vanes are arranged in arcuate form on the same diameter. As a result of the missing covering of these vanes, no pressure increase occurs downstream of the impeller. The vanes arranged in the wheel side space conduct the vortex encumbered flow to an outlet.

With the GB-A 112,292, a measure for influencing the cavitation behavior of spiral housed pumps is disclosed. In comparison with conventional spirals which extend over 360°, in this case a spiral extending over only 240° is used. 120° of the circumference of the impeller are covered. In this case the respective first half of the impeller cover viewed in the flow direction exhibits a gradual blocking of the impeller outlet cross section, while the second half effects a complete blockage of the impeller outlet cross section. These blocking measures result in a pulsating pump operation which causes noise.

The U.S. Pat. No. 2,362,514 teaches the use of a gap increase between the impeller outlet and the diffuser inlet in turbochargers. The gap has a wedge-form cross section. In this way secondary flows in the transition between the impeller and the diffuser are influenced in order to avoid vibrations. However, this measure causes losses of efficiency.

SUMMARY OF THE INVENTION

The invention is therefore based on the problem of developing a solution by means of which the hydraulic noise behavior is clearly reduced without any negative influence on the pump efficiency.

The solution of this problem has been achieved according to the present invention as discussed below. The diffuser which is arranged following an impeller and which converts the speed energy of the flow medium generated by the impeller into a pressure energy, may be a spiral with at least one leading edge or a following diffuser with the leading edges of the respective diffuser blades. In contrast to the usual embodiments, in which the leading edges extend parallel to the axis of rotation, the leading edges of the diffuser according to the invention have an oblique course relative to the axis of rotation of the impeller. Irrespective of whether a spine of a spiral forming a leading edge is involved or the leading edges of diffuser blades, their oblique orientation has no disadvantageous effects on the function of the diffuser since their function of converting the speed energy of the medium into pressure energy by means of an increasing expansion of the cross-section in the flow direction is not affected by the course of the leading edge. In this regard, the oblique orientation of the leading edge is chosen such that the gap between the impeller and the leading edge remains substantially uniform in size. Depending on the type of diffuser, this requires one or more spatially curved three-dimensional blades. Their use also results in better hydraulic conditions at the same time.

For example, in a diffuser the wall surfaces of the diffuser blades within the diffuser have an oblique orientation which follows the oblique orientation of the leading edges. The blade channel formed therebetween thus has—simply stated—a cross-sectional surface which is similar to a parallelogram. In this case, the course of the leading edge is decisive. The conforming course of the blade surfaces of the diffuser can correspond to the customary practices or layout rules. The important thing is a course which corresponds to the use of the diffuser in accordance with its specifications. This applies in a similar manner to the spine of a spiral housing constructed as a single blade. In a diffuser, the inlet into the diffuser can be configured for an optimal noise reduction; the diffuser itself can be designed for the desired pressure conversion, and the outlet of the diffuser can be constructed for the most favorable inflow conditions for a subsequent impeller. The diffuser itself should facilitate the desired pressure conditions between its boundary wall surfaces.

The design according to the invention of the leading edges of a diffuser arranged following an impeller can also be explained by means of another example. It is assumed that the guide vanes of a diffuser arranged between two annular wall surfaces or the leading edge or the spine of a spiral can be changed in their width in a telescoping manner and are fastened along their length in an articulated manner to the wall surfaces. The leading edges according to the invention can then be produced by the rotation of one wall surface with respect to the other wall surface and about their center axis. In this case, the course of the blade or spine surfaces arranged following the leading edges will change correspondingly. However, any other possible blade surface course can also be constructively realized which causes an energy conversion according to specifications as a result of a diffuser-like expansion of the guide channel cross-section.

As an additional advantage of this type of design of the leading edges of a diffuser device, it has been found in practical tests that surprisingly they exhibit significantly improved cavitation behavior. In comparison to a customary course of the leading edges, it was demonstrated that, under the same operating conditions of the centrifugal pump, the leading edge according to the invention did not exhibit any cavitation damage. In contrast, the conventional leading edge experienced an abrasion of material caused by cavitation phenomena. And as a further advantage it has also been found that those vanes of a diffuser which were designed according to the invention, exhibited a significantly lower dynamic stress to the blades during operation. This provides the possibility of subjecting the guide devices according to the invention to higher loading or to provide highly stressed centrifugal pumps with a safety advantage in that the stress on their leading edges is reduced. An important advantage of the invention is the possibility of constructing the radial distance between one or more leading edges of the diffuser and the impeller smaller than heretofore customary. This results in hydraulic advantages. Higher forces which possibly may result from the oblique positioning of the leading edges can be used to compensate for the axial thrust.

When the trailing edges of the impeller blades pass by, a linear axially parallel encounter no longer takes place with the following leading edge or edges of the diffuser. Instead, the encountering edges glide past one another in a point-like manner in each case. The resulting pressure pulse therefore takes place over a much longer time period and is limited to a considerably smaller spatial area. The buildup of sudden pressure pulsations is therefore reduced very decisively. Instead of a sudden high dynamic stress, a cyclic stress will now occur with a considerably lower stress level. The cause of this is a longer residence time of the blade trailing edges in the area of the respective leading edge of the diffuser. As a result of the design according to the invention, a blade channel of an impeller delivers simultaneously into two inlet channels of a following diffuser. This also applies to a spiral as a diffuser, because its spine-shaped leading edge will then extend diagonally with respect to the impeller outlet width and is provided with a channel guide which crosses over into the main spiral.

In a diffuser according to the invention, irrespective of whether it is a diffuser wheel or a spiral, as a function of size of the impeller-diffuser combination which is used as well as of the number of vanes which are used, there are a large number of possible oblique positions of the leading edge. The leading edge or edges can, for example, also be arranged such that they extend from the same to an opposite oblique positioning with respect to the impeller blade trailing edges. In this way a considerably larger free space is provided for influencing the generation of noise by the interaction between the blade edges which glide past one another. In the case of an arrangement of the blade edges of the impeller outlet and the diffuser inlet with an oblique array in the same direction, an angular offset must be observed in order to preclude a linear passage between the leading edge and the impeller blade. In the case of spiral housings, the wall surface following the leading edge of a spine has a flow-supporting transition into the unchanged spiral space which follows.

When a diffuser according to the invention is used following an impeller with narrow gaps between the impeller and the diffuser, noise reductions of the pressure pulsations of a magnitude of up to 20 dB can be observed. The obliquely extending leading edges have a length which corresponds to 0.1 to 1.2 times an impeller blade pitch at the impeller outlet. In the circumferential direction, the ends of the leading edges which transition into the boundary wall surfaces consequently are arranged to be offset with respect to one another.

Depending on the geometry of the diffuser, for example, when used in multistage pumps, it is also possible to provide a non-linear course for the leading edges. These may also make sense when impellers are used whose blade trailing edges have a course which makes a non-linearly extending leading edge of a diffuser device appear useful. An arrow-shaped construction which, comparably to a swept-back wing, can have a positive or negative sweepback, can be mounted on the leading edge as well as on the blade trailing edge of the impeller. Corresponding combinations make possible a significant reduction of the noise behavior for the most varied applications. A sweepback of the leading edges may be advantageous, for example, in the case of double-flow impeller constructions in order not to allow the formation of axial thrust forces. In conventional single-flow impellers, as a result of the selected course of an oblique orientation, an influence can be exerted on the axial thrust of an impeller. This may be a function of the pressure distribution at an impeller outlet at the respective design point, since depending on the design principles used in an impeller, the resulting pressure component can be displaced toward the suction or delivery side cover disk of the impeller. By means of an appropriately selected oblique orientation of the leading edge or edges of a diffuser, it is then also possible to influence the characteristic curve of the pump. The point of optimal efficiency can then be displaced to a smaller or larger amount. As a positive side effect, by means of this oblique positioning, there will be a greater freedom with respect to the design of a centrifugal pump.

With respect to the reduction of noise, the diffuser according to the invention is independent of an impeller. It thereby offers the possibility of subsequently retrofitting already installed systems if these are provided with an exchangeable diffuser or can be adapted correspondingly.

Based on practical tests with a diffuser with obliquely extending leading edges, it has been found that changes of the gap width between the impeller and the diffuser affect the steepness of the characteristic curve of a pump. An expansion of the gap results in a characteristic pump curve with a flatter slope. However, this additional positive side effect has no negative influence on the noise development. In the case of very narrow gaps, which in conventional diffusers otherwise result in strong pressure pulsations, optimal intake conditions occur with an extreme reduction of noise.

Another embodiment envisions that the distance may vary between the cylinder planes on which the leading edges of the diffuser and the trailing edges of the impeller blades are respectively situated. This characteristic offers several advantages. Thus, in a diffuser, different distances can be provided between the impeller outlet diameter and the leading edges of the diffuser. A different distance can just as well be provided between successive diffuser vanes; that is, every second leading edge would then have the same spacing.

Thus, on the one hand, it is possible to directly influence the noise emissions produced by the impeller and the diffuser and, on the other hand, the forces which act on the diffuser can be absorbed better. The general design rule, according to which for noise reasons the number of blades of an impeller should not be identical to the number of vanes of a diffuser no longer has to be observed in a centrifugal pump with a diffuser constructed according to the invention.

Embodiments of the invention are illustrated in the drawings and will be explained in detail in the following.

DETAILED DESCRIPTION OF THE PREFERRED EMBODIMENT

Figure 1:
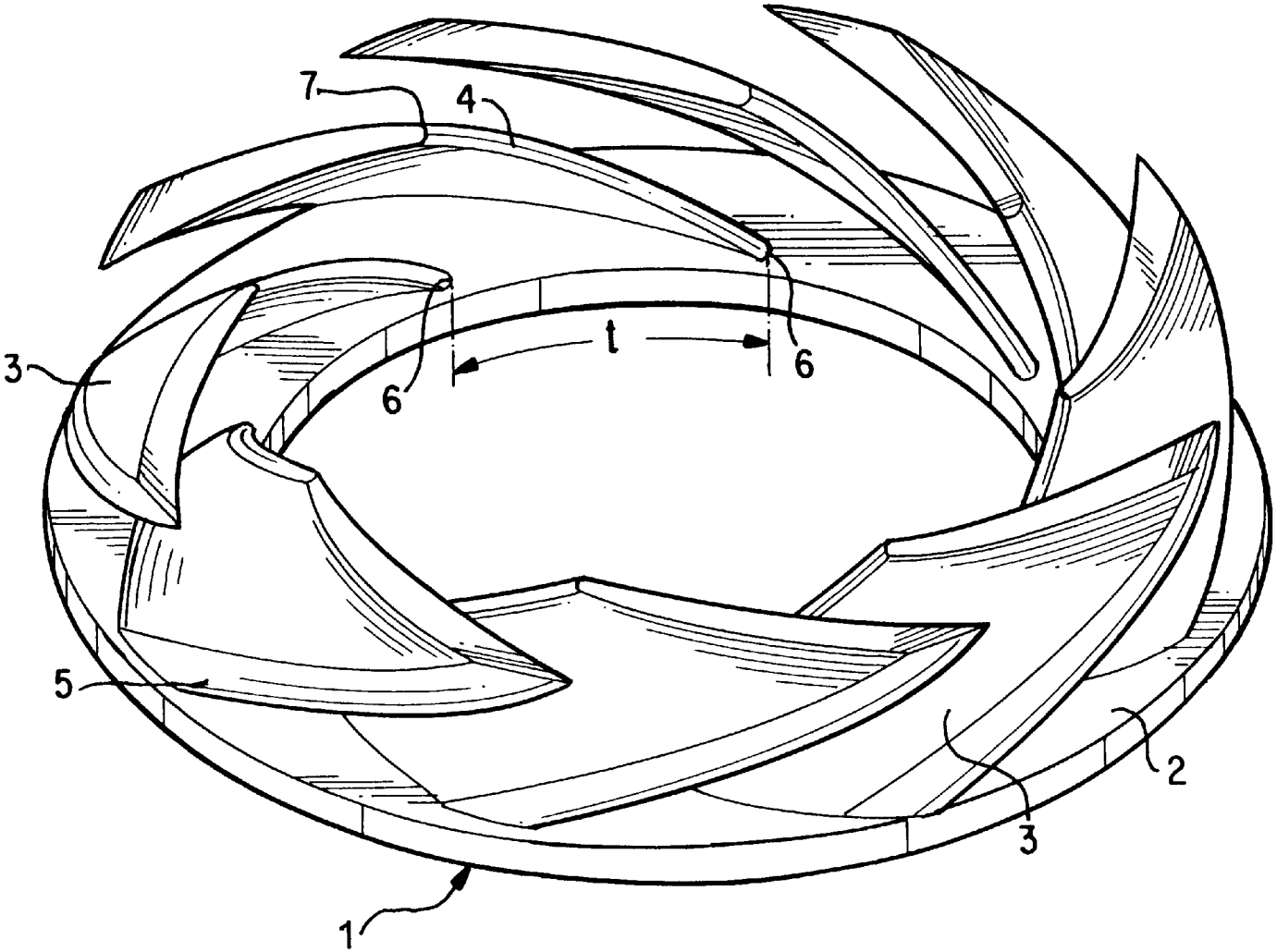
FIG. 1 shows a diffuser device as a perspective illustration of a diffuser wheel.

In FIG. 1 a perspective illustration of a diffuser is shown as a diffuser device 1. For reasons of better viewability, the diffuser is shown open. Normally, a diffuser comprises two wall surfaces between which connecting guide vanes are arranged. The diffuser shown here comprises a wall surface 2 with which several diffuser vanes 3 are fixedly connected. In the embodiment illustrated here, the leading edges 4 of the diffuser vanes 3 are situated on a cylinder surface which is arranged concentrically with respect to the axis of rotation of the impeller. On this cylinder surface, the leading edges follow the curvature of the cylinder surface and extend in a crossing manner with respect to the axis of rotation. In this embodiment viewed in a meridian section, both the leading edges 4 as well as also the trailing edges 5 extend axially in parallel. The meridian section thereby represents the surface which a blade passes through (glides by) as it rotates about the axis of rotation of the impeller.

In the representation selected here, the leading edges have an oblique orientation or overlap which is equal to the blade pitch t of the diffuser device 1. The leading edge 4 extends from its one end point 6, which is situated on the wall surface 2, to its other end point 7 which in this case is positioned in free space. The oblique orientation of the leading edge 4 was selected such that, viewed in the direction of the axis of rotation lying in the plane of the drawing, the end point 7 is situated above the end point 6 of an adjacent diffuser vane 3. In this case, the mutual offset of the end points 6, 7 of a leading edge 4 corresponds to a single blade pitch. Depending on the size of the diffuser device as well as the blade number and the shape of the impeller which is used, or depending on the specific rotational speed $n_q$ of the centrifugal pump, the oblique orientation may correspond to 0.1 to 1.2 times a blade pitch t of an impeller. In centrifugal pump impellers with a small $n_q$, as they are known from radial impellers, an oblique orientation is selected which maximally corresponds to a blade pitch at the impeller outlet. Usually, the inclination in such impellers will correspond to a lower value in order to be able to manufacture the inlet cross-section of a correspondingly small diffuser in an advantageous manner. In impellers with a larger $n_q$, because of the larger impeller outlet width, which normally is also followed by a correspondingly wider diffuser, an oblique orientation is used which extends to 1.2 times a blade pitch.

The relation between the impeller blade number and the pitch will be explained with reference to an example. If an impeller with 8 blades is used, then the trailing edges of the impeller would be situated at a circumferential angle of 45°. An oblique orientation of the leading edges of a diffuser device with half the impeller blade pitch would then, based on the circumferential angle of 45°, correspond to an oblique orientation of 22.5°. In an impeller with 9 blades, their blade pitch on the outer circumference would be =360°:9=40°. In an oblique orientation corresponding to half the impeller blade pitch, the starting and end points of a leading edge of a diffuser device relative to the circumferential angle of the impeller would be arranged to be offset by 20° with respect to one another. In multi-blade diffuser devices it has been found to be advantageous for hydraulic reasons if their blade number is larger than the blade number of the impeller.

So that it can be seen more easily, the diffuser device 1 shown here is depicted as a so-called open diffuser. It can be installed directly and, for example, in a multi-stage pump, can rest with the open side adjacent a stepped housing wall. However, it is also readily possible to construct this diffuser as a so-called closed diffuser. In this case, the vanes would be arranged between two wall surfaces.

Figure 2:
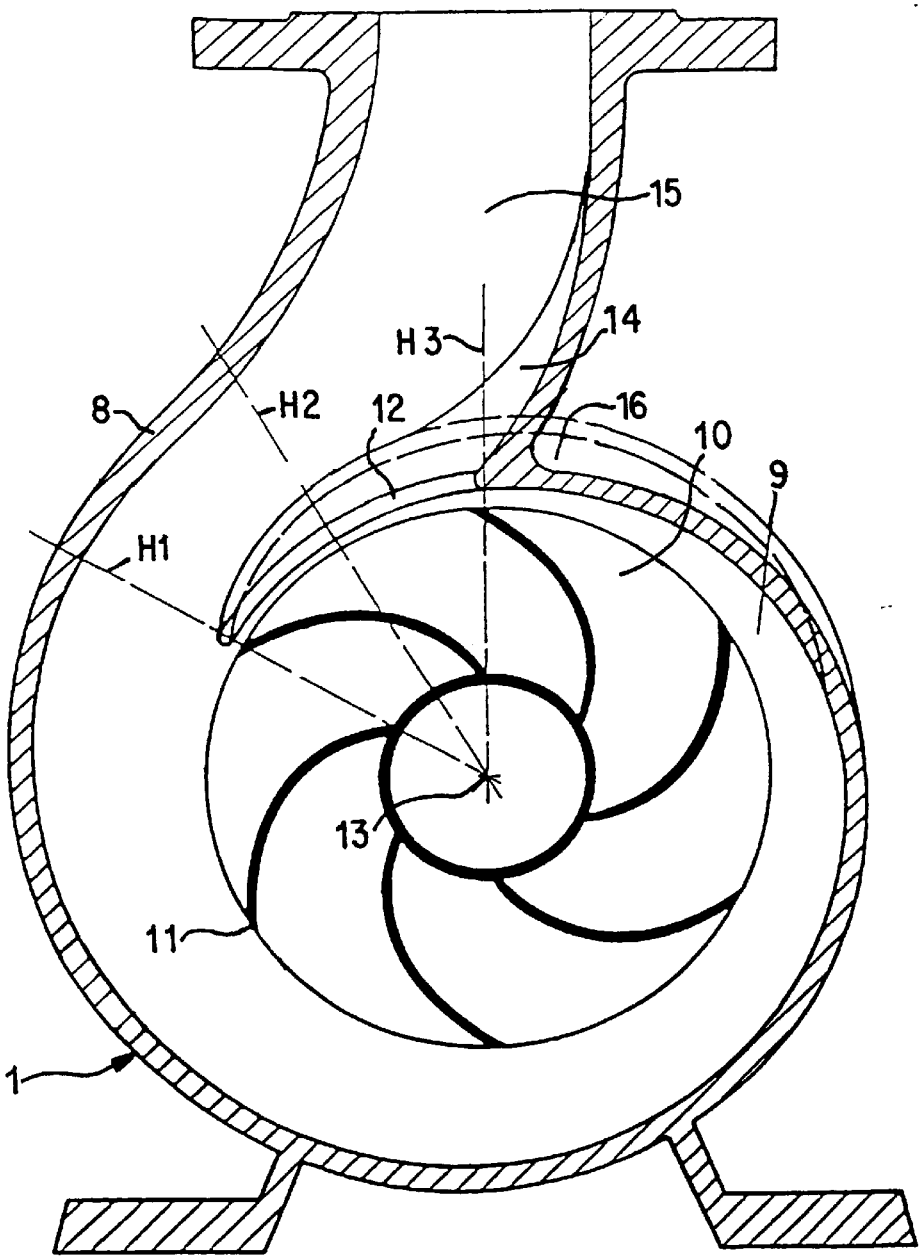
FIG. 2 shows a section through a centrifugal pump with a spiral as the diffuser device.

FIG. 2 shows a sectional view of a housing 8 of a centrifugal pump. Here, the diffuser device 1 is constructed as a spiral 9. An impeller 10 is arranged inside the housing 8. During operation, the trailing blade edges 11 of the impeller pass the leading edge 12. This leading edge 12 extends between the section lines H1–H3 and runs diagonally to the axis of rotation 13 extending perpendicular to the plane of the drawing. As shown in FIGS. 2–5, the trailing blade edges 11 are arranged such that they define a cylindrical surface of rotation coaxial with the axis of rotation 13. Medium emerging from the impeller 10, is guided by means of a shaped piece 14, partially into the pressure fitting 15 and partially into the spiral 9. For this purpose, the leading edge as well as the spiral has a more or less pronounced projection or fluting 16. In this embodiment it has been illustrated in an enlarged manner for a clearer view. This cross-sectional change of the spiral is designed according to the desired operating conditions. Beginning at the leading edge 12, the projection or fluting 16 is developed like a guide channel into the spiral. In this way, a largely undisturbed discharge from the impeller into the pressure fitting and, when the impeller rotates further, the transition into the guide duct can take place. This division of the output flow in the area of the leading edge, to a certain extent, facilitates a smooth, low-noise transition in the spine area.

The oblique orientation of the leading edge 12 situated on the spine can extend to a blade pitch of the impeller or, in the case of wide impeller trailing surfaces, can also extend beyond it. In this case also, the important thing is to maintain an approximately uniform gap between the impeller outlet and the start of the spiral.

Figure 3:
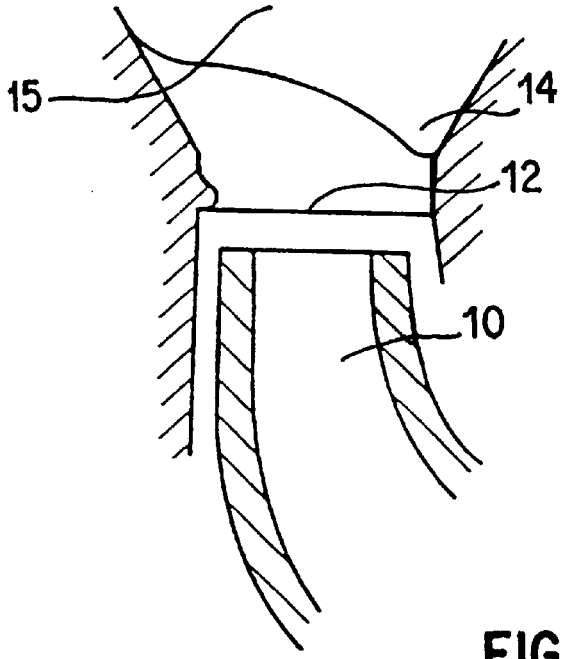
FIGS. 3–5 show different sectional views through the spiral.

FIG. 3, which is a view along section line H 1, shows a view of the leading edge 12 which extends obliquely to the plane of the drawing and which guides medium emerging from the spiral 9 into the pressure fitting 15.

Figure 4:
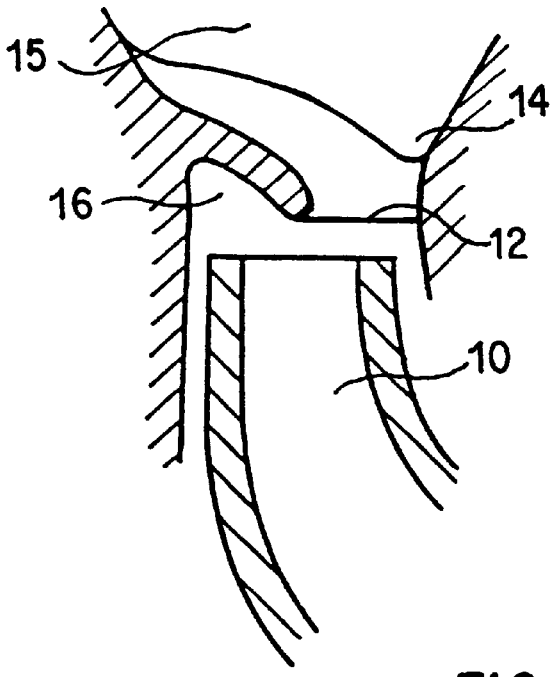

A section along line H 2, which is situated behind it in the flow direction, is shown in FIG. 4. Medium emerging from the impeller 10 flows, on the one hand, into the flute 16 and thence further into the spiral 9. Another portion passes along the shaped member 14 into the pressure fitting 15. Depending on the length or the oblique orientation of the leading edge 12, for the duration of the passing of a respective blade channel of an impeller 10 along the leading edge 12, a small portion of the flow medium can pass from the impeller 10 directly into the pressure fitting 15. A resulting loss of efficiency is not to be expected, and if it occurs, can be eliminated by simple adaptation of the impeller.

Figure 5:
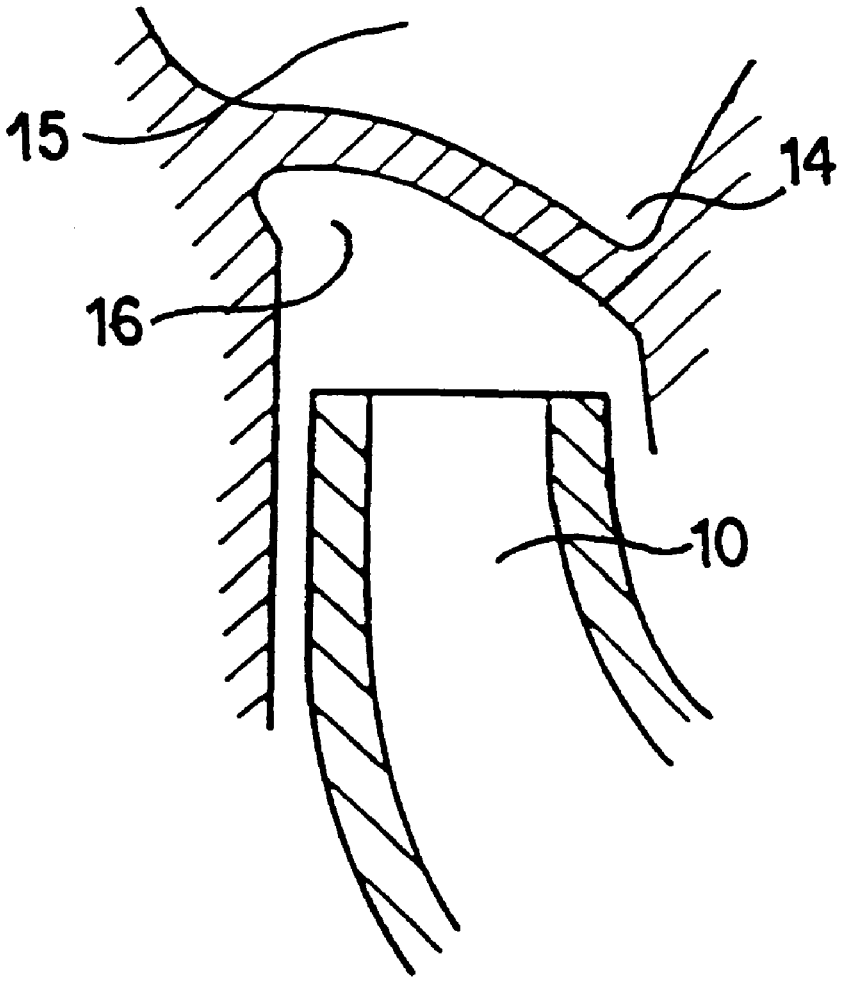
Figure 6:
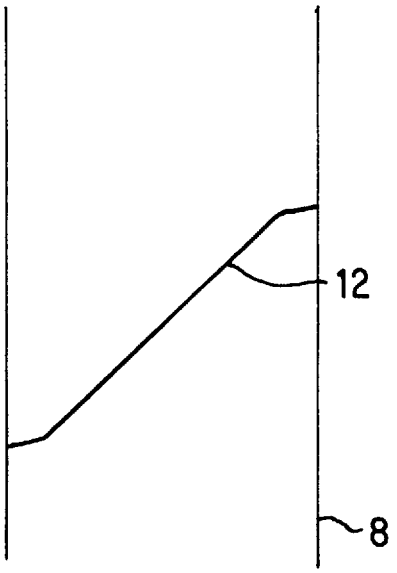
FIGS. 6–9 show views of an example of a leading edge with different possible courses or forms.
Figure 7:
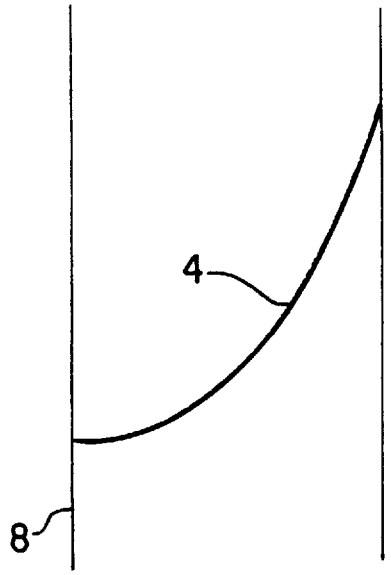
Figure 8:
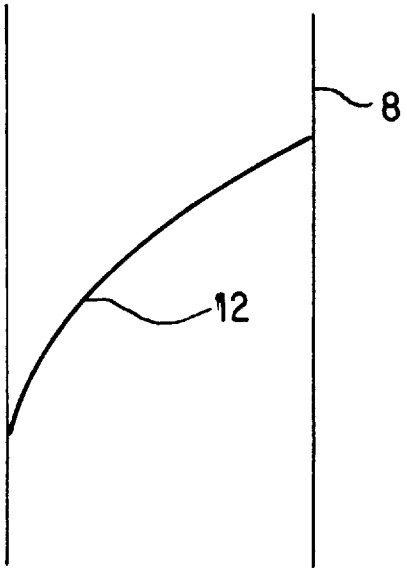
Figure 9:
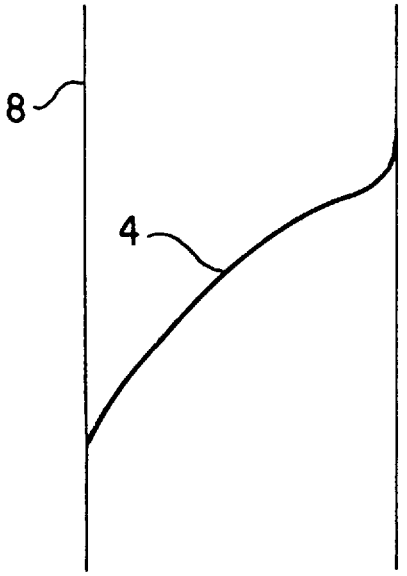

In FIG. 5 the cross-section at the end of the leading edge through the spiral 9 is shown according to section H 3. Starting from this point, the flow medium emerging from the impeller 10 is guided by the fluting 16 or the shaped projection into the following spiral.

As shown in the developed views of FIGS. 6 to 9 on the example of respective individual leading edges 4, 12, the course of a leading edge 4, 12 may also have a shape which deviates from a straight line. These may be continuous or discontinuous courses, abrupt changes or the like. Depending on the pressure distribution profile prevailing at an impeller outlet, a course of a leading edge 4, 12 which offers the most favorable conditions with respect to the stability, the noise reduction and the axial thrust action, can be selected as needed. The courses shown in FIGS. 6–9 are only exemplary, and the subject matter of the invention is not limited to them. Here also, the selected course does not result in any disadvantageous effects on the behavior of a diffuser channel or a spiral chamber, since its capability for energy conversion is primarily determined by its cross-sectional relationships.

What is claimed is:

1. A centrifugal pump comprising a housing, at least one impeller comprising a plurality of impeller blades and having an impeller outlet, said impeller being arranged in said housing so as to be rotatable about an axis of rotation, and a diffuser device arranged following the impeller for converting kinetic energy imparted by the impeller to a pumped medium into pressure energy, said diffuser device comprising flow-guiding surfaces extending toward larger diameters and having leading edges situated opposite the impeller outlet, said leading edges being oriented at an angle relative to the axis of rotation of the impeller such that as the impeller rotates, trailing edges of the impeller blades pass by said leading edges of the diffuser device and punctiform overlap occurs between the respective trailing edges of the impeller blades and the leading edges of the diffuser device, said leading edges of the diffuser device defining a cylindrical surface coaxial with said axis of rotation.

2. A centrifugal pump according to claim 1, wherein said flow-guiding surfaces of said diffuser device have trailing edges oriented at an angle relative to the axis of rotation of the impeller.

3. A centrifugal pump according to claim 1, wherein said leading edges of the flow-guiding surfaces have a length greater than the diffuser device is wide.

4. A centrifugal pump according to claim 1, wherein the impeller blades define an impeller blade pitch, and said leading edges each have a beginning point and an end point which are circumferentially offset relative to each other by 0.1 to 1.2 times the impeller blade pitch.

5. A centrifugal pump according to claim 1, wherein there is an approximately constant gap between the impeller outlet and said leading edges.

6. A centrifugal pump according to claim 1, wherein said leading edges are non-linear.

7. A centrifugal pump according to claim 6, wherein said leading edges have a swept back configuration.

8. A centrifugal pump according to claim 1, wherein said impeller blades have trailing edges with a swept back configuration.

9. A centrifugal pump according to claim 1, wherein said impeller blades have trailing edges which define a cylindrical surface of rotation coaxial with said axis of rotation.

10. A centrifugal pump according to claim 9, wherein said trailing edges extend parallel to said axis of rotation.

11. A centrifugal pump comprising:

an impeller having a plurality of impeller blades, each of said impeller blades having a trailing edge, said impeller being rotatable about an axis of rotation in a rotational direction; and a diffuser device arranged adjacent said impeller, said diffuser device having at least one stationary flow-guiding surface, each said flow-guiding surface having a leading edge extending obliquely to said axis of rotation and obliquely to said trailing edge of said impeller blade, said at least one leading edge of the diffuser device defining a cylindrical surface coaxial with said axis of rotation, wherein as the impeller rotates, the trailing edges of the impeller blades pass by said at least one leading edge of the diffuser device and punctiform overlap occurs between the respective trailing edges of the impeller blades and said at least one leading edge of the diffuser device.

12. A centrifugal pump according to claim 11, wherein said flow-guiding surfaces of said diffuser device have trailing edges oriented at an angle relative to the axis of rotation of the impeller.

13. A centrifugal pump according to claim 11, wherein said leading edges of the flow-guiding surfaces have a length greater than the diffuser device is wide.

14. A centrifugal pump according to claim 11, wherein the impeller blades define an impeller blade pitch, and said leading edges each have a beginning point and an end point which are circumferentially offset relative to each other by 0.1 to 1.2 times the impeller blade pitch.

15. A centrifugal pump according to claim 1, wherein there is an approximately constant gap between the impeller outlet and said leading edges.

16. A centrifugal pump according to claim 11, wherein said leading edges are non-linear.

17. A centrifugal pump according to claim 11, wherein said trailing edges define a cylindrical surface of rotation coaxial with said axis of rotation.

18. A centrifugal pump according to claim 11, wherein said trailing edges of said impeller blades extend parallel to said axis of rotation.

19. A centrifugal pump according to claim 11, wherein each said flow-guiding surface extends from a respective of said leading edges with an increasing distance from said axis of rotation along said rotational direction.

* * * * *